United States Patent [19]

Gerwick, Jr.

[11] 4,106,301

[45] Aug. 15, 1978

[54] BUILDING SYSTEM FOR SEISMIC-ACTIVE AREAS

[75] Inventor: Ben C. Gerwick, Jr., Oakland, Calif.

[73] Assignee: Kajima Corporation, Tokyo, Japan

[21] Appl. No.: 782,258

[22] Filed: Mar. 28, 1977

Related U.S. Application Data

[63] Continuation-in-part of Ser. No. 644,017, Dec. 24, 1975, Pat. No. 4,045,968.

[51] Int. Cl.[2] ..... E02B 17/00; E02D 5/00

[52] U.S. Cl. ..... 61/86; 61/50; 61/95; 52/167

[58] Field of Search ..... 61/86, 50, 51, 87, 88, 61/95, 96, 98; 52/167, 169, 170; 248/357

[56] References Cited

U.S. PATENT DOCUMENTS

| | | | |
|---|---|---|---|
| 2,002,934 | 5/1935 | Collins | 52/167 |
| 2,690,074 | 9/1954 | Jones | 52/167 |
| 3,350,821 | 11/1967 | Jones | 52/167 |
| 3,998,062 | 12/1976 | Lange | 61/50 |

*Primary Examiner*—Jacob Shapiro

*Attorney, Agent, or Firm*—Beveridge, DeGrandi, Kline & Lunsford

[57] ABSTRACT

A building system for seismic-active areas includes a base structure and an upper structure connected to the base structure by a system of connector means which collectively provide a relatively rigid interconnection under normal conditions and a relatively flexible connection when subjected to seismic disturbances. When the building system is subjected to seismic disturbances, rigid connector members fail by buckling and other connector members flex without failing to provide the relatively flexible interconnection.

14 Claims, 5 Drawing Figures

BUILDING SYSTEM FOR SEISMIC-ACTIVE AREAS

REFERENCE TO RELATED APPLICATION

This is a continuation-in-part of U.S. patent application Ser. No. 644,017 filed Dec. 24, 1975, for Offshore Platform and Method for its Installation, now U.S. Pat. No. 4,045,968 the entirety of which is incorporated herein by reference.

BACKGROUND AND SUMMARY

This invention relates to a building system in which an upper structure is relatively rigidly connected to a base structure during normal conditions but which, when subjected to seismic disturbances, results in a relatively flexible interconnection between the upper structure and the base structure. The system disclosed herein is particularly useful in connection with offshore structures in which a large portion of the upper structure is surrounded by water to increase significantly its effective mass in the event of earthquake. Such offshore structures include major bridge piers, nuclear generator facilities, platforms for storing liquified gas and petroleum products, oil drilling platforms and oil production platforms.

Building systems have previously been devised for connecting an upper structure to a base structure relatively rigidly under normal conditions and relatively flexibly under earthquake conditions. In one such system, upper structures have been supported an elastomer pads formed of interleaved layers of steel and elastomers bonded together to permit lateral shifting of the structre under earthquake conditions. In such systems, the rigid connection under normal conditions is provided by horizontal restraining bars which connect the upper structure to the base structure in a manner which causes the bars to fail by torsion in the event of an earthquake, thereby enabling the elastomer pads to permit lateral shifting of the upper structure. In another system, lateral restraint has been provided by horizontally oriented pots filled with lead which is extruded from the pots under earthquake conditions to provide a less rigid lateral support than under normal conditions.

In earlier application Ser. No. 644,017 filed Dec. 24, 1975, a system was disclosed which included laterally oriented rods which rigidified a normal connection but failed under earthquake conditions, and an elastomeric material which provided a more flexible connection after failure of the rods.

According to the present invention, the connection between the base structure and the upper structure is provided by connector means, some of which are relatively rigid but fail by buckling under earthquake conditions, and others of which are flexible so as to flex without failing when the system is subjected to seismic disturbances. The flexible members may be stressed load-bearing elements, and the rigid members may be unloaded and arranged only to sustain forces produced by lateral relative movement between the structures. Preferably, the buckling rigid connectors are vertically oriented fluted tubes and the flexible connectors are vertically oriented cylindrical tubes. Both types of tubes are symmetrical with respect to their individual vertical axes so as to provide omnidirectional flexion and resistance to lateral shifting between the upper structure and the base structure. In event of buckling of the rigid members, a standby replacement set of such members may be released for movement to operable positions.

THE DRAWINGS

BRIEF DESCRIPTION OF THE PREFERRED EMBODIMENT

Figure 1:
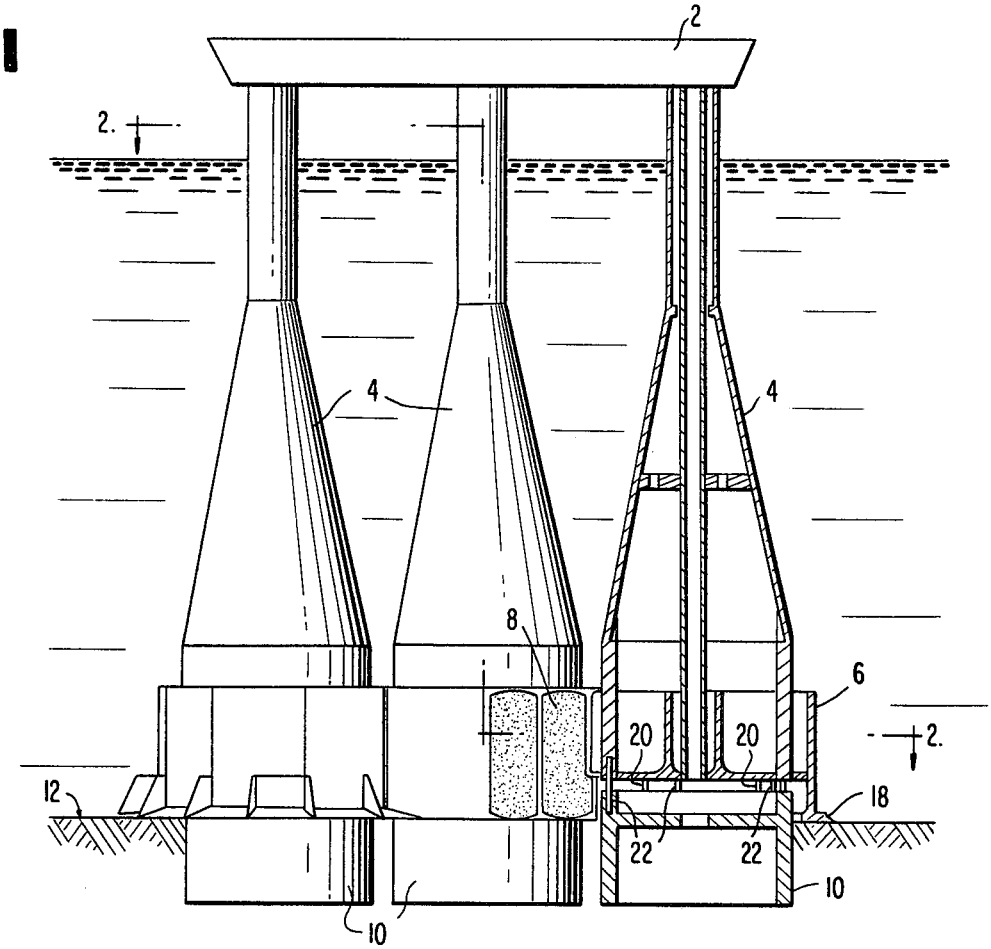
FIG. 1 is an elevational view of an offshore platform constructed according to the invention, taken partially in section.

FIG. 1 shows a structure resembling that disclosed in earlier application Ser. No. 644,017 filed Dec. 24, 1975, in the respect that it includes an above-water deck 2 supported at the upper end of towers 4, the lower ends of which are rigidly connected to a base raft 6. The height of the towers 4 is greatly reduced in FIG. 1 for convenience of illustration. The base raft 6 rests on the ocean floor to provide vertical support to the towers 4 and deck 2. The base raft 6 is preferably formed of concrete and is provided with a plurality of cavities fillable with ballast 8 to increase its mass. Lateral shifting of the base raft 6 is deterred by caissons 10 which are connected to the base raft 6 and project downwardly to become embedded in the ocean floor 12.

Figure 2:
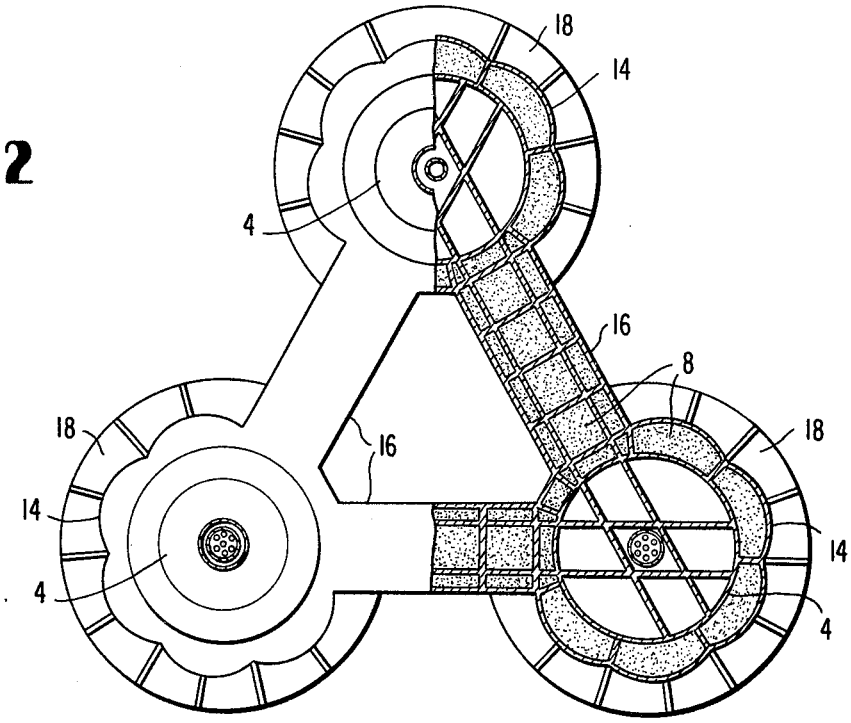
FIG. 2 is a plan view of the base raft of the system of FIG. 1 as seen along the line 2—2 in FIG. 1.

As seen in FIG. 2, the base raft 6 is formed of three horizontally circular sections 14 and interconnecting sections 16 which provide the general configuration of an equilateral triangle. Each circular section 14 is concentric with its corresponding tower 4 and caisson 10, and is provided with a horizontal projecting flange 18 which increases the effective area of the base raft resting on the ocean floor.

Referring back to FIG. 1, it will be seen that the caisson 10 is connected to the base raft and tower structure by means of a series of vertical dowels 20 and 22 which bridge a vertical gap between the base structure provided by caisson 10 and the upper structure provided by the base raft 6, towers 4 and deck 2.

Figure 3:
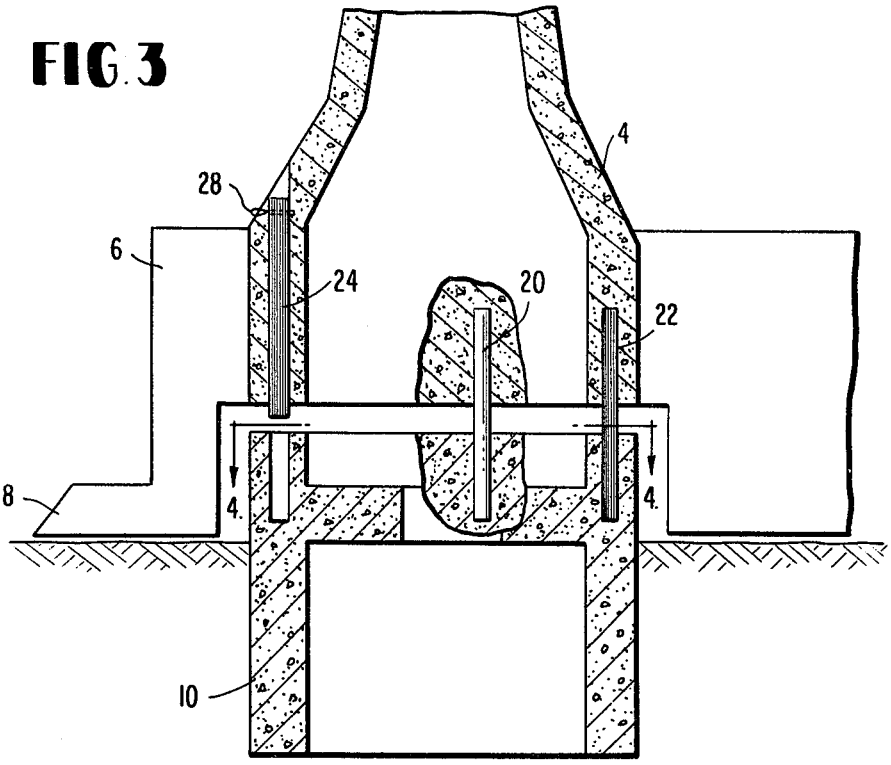
FIG. 3 is an enlarged sectional diagrammatic view showing the interconnection between the caisson base and the upper structure which includes the base raft and towers.
Figure 4:
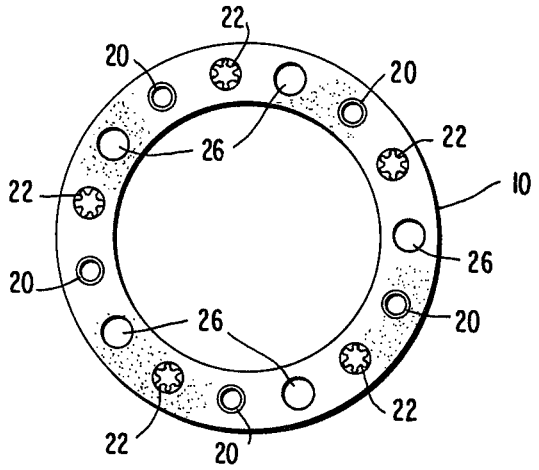
FIG. 4 is a sectional view as seen along the line 4—4 in FIG. 3.

In FIG. 3, only three dowels are shown, it being understood that these are only representative of the larger number of dowels as shown in FIGS. 1 and 4.

The dowels 20 are cylindrical tubes of annular cross section, formed of steel of a flexibility which enables the base raft 6 to move laterally with respect to the caissons 10 without failure of the tubular dowel 20. The upper end of each of the dowels 20 is rigidly connected axially and radially to the base of tower 4 and the lower end of each of the dowels 20 is rigidly connected axially and radially to the caisson 10 so that vertical forces will be transmitted between the upper structure and the base structure.

The dowels 22 are axially unloaded. They are slidable vertically in aligned bores in the tower 4 and caisson 10, and serve to provide lateral rigidity in the connection between these elements, such lateral rigidity being desirable in enabling the tower structure to withstand normal wave action and storm wave action without setting up destructive dynamic amplification. These dowels 22 provide a connection which will yield at horizontal shear forces which exceed those produced by the design storm wave.

Figure 5:
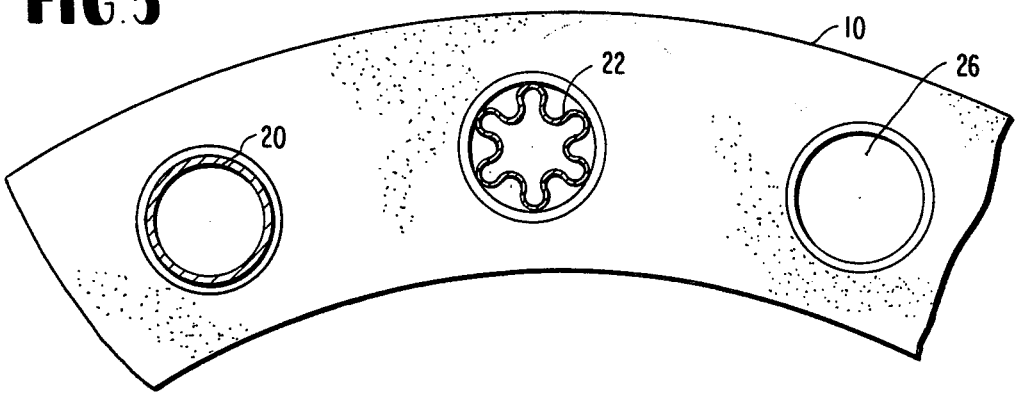
FIG. 5 is an enlarged sectional view of a portion of the structure llustrated in FIG. 4.

The rigidity of the dowels 22 is attributable in part to their fluted cross sections which is best illustrated in FIG. 5. It will be evident that this cross section affords a greater resistance to lateral shearing forces than the dowels 20 of circular cross section. Likewise, it will be evident that fluted dowels 22 are more susceptible to buckling when there is any lateral shift between the caisson base 10 and the tower structure 4.

It will be noted that the piles 20 and 22 are symmetrical with respect to their individual vertical axes. This is particularly desirable since it causes the rigidity and flexibility of the system to be omnidirectional. While it would be possible to provide the more rigid dowels with unfluted walls of greater thickness, it is preferred to use the fluted configuration since the load at which such dowels will fail is more predictable than with hollow cylindrical dowels.

Under normal conditions, the system will be as illustrated in FIGS. 3–5. Any vertical forces between the caisson 10 and the tower 4 is borne by the hollow cylindrical dowels 20, while significant lateral displacement is resisted primarily by the fluted dowels 22. Under normal conditions, including conditions when the sytem is subjected to storm waves, the dowels 20 and 22 continue to function in this manner. However, when the system is subjected to the accelerations of a magnitude occuring in very strong seismic disturbances, the fluted dowels 22 will fail by buckling. In such an event, the structural interconnection becomes less rigid. The more flexible dowels 20 will remain intact but will deform to accommodate lateral shifting movement between the structures 10 and 4. After the seismic disturbance has passed, the flexible dowels 20 will restore the system to the illustrated position.

After buckling failure of the dowels 22, there is some risk that the entire structure will be more vulnerable to wave action, presenting a risk of harmonic movement and dynamic application of the upper structure which may lead to ultimate failure. To avert such a condition, it is desirable to provide a standby set of fluted tubes as illustrated at 24 in FIG. 3. This tube 24 is shown in an inoperative position where it is supported in the wall of tower 4 but spaced from the caisson 10. A complete set of these standby fluted dowels is provided, capable of being released into the normally vacant openings 26 in the caisson.

The standby fluted dowels 24 are normally held in their inoperative retracted positions by a release means such as pin 28. A remote cable or other actuator is provided for withdrawing the pins 28 from the dowels 24, causing the dowels 24 to fall gravitationally (or be forced down by hydraulic rams) into the vacant bores, 26 in the caisson where they will occupy their operable positions corresponding to those of the buckled tubular dowels 22. The buckled dowels 22 may be replaced and the standby set of dowels 24 may then be restored to their inoperable positions for subsequent release in the event of a subsequent earthquake.

Some of the principles of this invention are outlined and discussed in our paper presented to the American Society of Civil Engineers, National Water Resources and Ocean Engineering Convention held in San Diego, Calif., Apr. 5–8, 1976. This presentation was the subject of our preprint 2728 which is incorporated by reference into this specification.

While only a preferred embodiment of the invention has been disclosed, persons familiar with the art will realize that the principles of the invention may be achieved by a diversity of structures. For example, the rigid connection between the base structure and upper structure may be provided with the axially buckling PEACU fenders extending radially between the base and upper structure. In offshore installations, the towers may be connected to the base raft by structures of the type disclosed herein. Numerous other variations and modifications will occur in the normal course of development, so it is emphasized that the invention is not limited to the embodiment disclosed herein but is encompassing of a wide variety of other structures which fall within the spirit of the following claims.

I claim:

1. A building system for use in areas susceptible to seismic disturbances, comprising, a base structure, an upper structure connected to the base structure and being laterally movable with respect to the base structure when subjected to seismic disturbances, connector means extending between and interconnecting the base structure and the upper structure, said connector means including a first set of members extending between said base structure and said upper structure and a second set of members extending between said base structure and said upper structure, said first set of members being relatively rigid and capable of failure by buckling, when the system is subjected to seismic disturbances, said second set of members being more flexible than said first set of members and capable of flexing without failing when the system is subjected to seismic disturbances whereby under normal conditions the first set of members will contribute to the strength of the connector means, and subjection of the system to seismic disturbances will cause the first set of members to buckle and the second set of members to flex without failure to preserve the connection and between the base structure and the upper structure.

2. A building system according to claim 1 wherein said first set of members is vertically unloaded and is constructed and arranged to be stressed only by lateral movement between said base structure and said upper structure, said second set of members being vertically loaded and constructed and arranged to transmit vertical forces between said upper structure and said base structure.

3. A building system according to claim 1 wherein each of said members is symmetrical with respect to its vertical axis whereby the lateral rigidity of flexibility of the connector means is omnidirectional.

4. A building system according to claim 3 wherein said first set of members are fluted tubes.

5. A building system according to claim 1 having a third set of members, means for supporting the third set of members in an inoperable standby position, means for releasing (or forcing) the third set of members for movement to an operable position where they extend between the base structure and said upper structure, said third set of members in said operable position being constructed and arranged to fail by buckling when the system is subjected to seismic disturbances, whereby upon failure of the first set of members the third set of members may be released for movement to their operable positions.

6. A building system according to claim 5 wherein each of said members is symmetrical with respect to its vertical axis whereby the lateral rigidity and flexibility of the connector means is omnidirectional.

7. A building system according to claim 6 wherein said first set of members are fluted tubes.

8. A building system according to claim 1 for use in offshore platforms wherein said base structure is formed of at least one caisson embedded in the ocean floor and the upper structure includes at least one vertical tower and a deck at the upper end of the vertical tower.

9. A building system according to claim 8 wherein said upper structure includes a base raft at the lower end of said vertical tower, said base raft resting on the ocean floor.

10. A building system according to claim 9 having a plurality of said caissons connected by said connector means to said base raft.

11. A building system according to claim 8 wherein each of said members is symmetrical with respect to its vertical axis whereby the lateral rigidity and flexibility of the connector means is omnidirectional.

12. A building system according to claim 11 wherein said first set of members are fluted tubes.

13. A building system according to claim 12 having a third set of members, means for supporting the third set of members in an inoperable standby position, means for releasing (or forcing) the third set of members for movement to an operable position where they extend between the base structure and said upper structure, said third set of members in said operable position being constructed and arranged to fail by buckling when the system is subjected to seismic disturbances, whereby upon failure of the first set of members the third set of members may be released for movement to their operable positions.

14. A building system for use in areas susceptible to seismic disturbances, comprising, a base structure, an upper structure connected to the base structure and being laterally movable with respect to the base structure when subjected to seismic disturbances, connector means extending between and interconnecting the base structure and the upper structure, said connector means including a first set of members extending between said base structure and said upper structure and a second set of members extending between said base structure and said upper structure, said first set of members being vertically unloaded and relatively rigid and capable of failure by buckling in response to lateral movement between said base structure and said upper structure produced by seismic disturbances, said second set of members being vertically loaded and connected to said upper structure and said base structure so as to transmit vertical forces between said upper structure and said base structure.

* * * * *